US011540042B2

(12) United States Patent
Wilson et al.

(10) Patent No.: US 11,540,042 B2
(45) Date of Patent: Dec. 27, 2022

(54) METHOD OF REJECTING INHERENT NOISE OF A MICROPHONE ARRANGEMENT, AND HEARING DEVICE

(71) Applicant: Sivantos Pte. Ltd., Singapore (SG)

(72) Inventors: Cecil Wilson, Erlangen (DE); Thomas Pilgrim, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 28 days.

(21) Appl. No.: 17/181,098

(22) Filed: Feb. 22, 2021

(65) Prior Publication Data

US 2021/0266657 A1 Aug. 26, 2021

(30) Foreign Application Priority Data

Feb. 20, 2020 (DE) ..... 102020202206.2

(51) Int. Cl.

| | |
|---|---|
| ***H04R 1/10*** | (2006.01) |
| ***G10L 21/0216*** | (2013.01) |
| ***H04R 1/40*** | (2006.01) |
| ***H04R 3/00*** | (2006.01) |

(52) U.S. Cl.

CPC ..... *H04R 1/1083* (2013.01); *G10L 21/0216* (2013.01); *H04R 1/1091* (2013.01); *H04R 1/406* (2013.01); *H04R 3/005* (2013.01)

(58) Field of Classification Search

CPC .... H04R 1/1083; H04R 1/1091; H04R 1/406; H04R 3/005; G10L 21/0216

USPC ..... 381/23.1, 56, 58, 71.1, 71.6, 74

See application file for complete search history.

(56) References Cited

U.S. PATENT DOCUMENTS

| | | | | |
|---|---|---|---|---|
| 7,082,204 | B2 | 7/2006 | Gustavsson | |
| 7,756,282 | B2 | 7/2010 | Rass et al. | |
| 8,238,575 | B2 | 8/2012 | Buck et al. | |
| 8,891,785 | B2 | 11/2014 | Sorensen | |
| 9,113,241 | B2 | 8/2015 | Osako et al. | |
| 9,830,899 | B1 * | 11/2017 | Every | G10L 21/0316 |
| 9,913,051 | B2 | 3/2018 | Pilgrim et al. | |
| 11,026,036 | B2 | 6/2021 | Tisch et al. | |
| 2012/0128163 | A1 * | 5/2012 | Moerkebjerg | H04R 25/407 381/23.1 |
| 2013/0322643 | A1 * | 12/2013 | Every | G10L 21/0232 381/71.14 |
| 2018/0018954 | A1 * | 1/2018 | Liu | H04R 1/1083 |

(Continued)

FOREIGN PATENT DOCUMENTS

| | | | |
|---|---|---|---|
| CN | 102254563 | A | 11/2011 |
| CN | 102404671 | A | 4/2012 |
| CN | 103117064 | A | 5/2013 |

(Continued)

*Primary Examiner* — William A Jerez Lora

(74) *Attorney, Agent, or Firm* — Laurence A. Greenberg; Werner H. Stemer; Ralph E. Locher

(57) ABSTRACT

A method for rejecting inherent noise of a microphone arrangement that includes a first microphone and a second microphone. The first microphone generates a first microphone signal from an ambient sound signal and the second microphone generates a second microphone signal from the ambient sound signal. A measure of correlation between the first microphone signal and the second microphone signal is ascertained, and inherent noise of the first microphone and/or of the second microphone in the first or second microphone signal is rejected on the basis of the measure of correlation.

7 Claims, 2 Drawing Sheets

(56) References Cited

U.S. PATENT DOCUMENTS

| | | | |
|---|---|---|---|
| 2018/0139546 | A1 | 5/2018 | Pilgrim et al. |
| 2022/0159376 | A1 | 5/2022 | Zhang |

FOREIGN PATENT DOCUMENTS

| | | | |
|---|---|---|---|
| CN | 110121889 | A | 8/2019 |
| CN | 110267160 | A | 9/2019 |
| DE | 102004010863 | B3 | 10/2005 |
| DE | 102011086728 | B4 | 6/2014 |
| EP | 2196988 | A1 | 6/2010 |
| WO | 2004008804 | A1 | 1/2004 |
| WO | 2013160735 | A1 | 10/2013 |

* cited by examiner

METHOD OF REJECTING INHERENT NOISE OF A MICROPHONE ARRANGEMENT, AND HEARING DEVICE

CROSS-REFERENCE TO RELATED APPLICATION

This application claims the priority, under 35 U.S.C. § 119, of German Patent Application DE 10 2020 202 206.2, filed Feb. 20, 2020; the prior application is herewith incorporated by reference in its entirety.

BACKGROUND OF THE INVENTION

Field of the Invention

The invention concerns a method for rejecting inherent noise of a microphone arrangement that includes a first microphone and a second microphone. The first microphone generates a first microphone signal from a sound signal from the surroundings and the second microphone generates a second microphone signal from the sound signal from the surroundings.

Hearing devices are normally used to compensate for hearing loss or impaired hearing in general. For this purpose, a hearing device normally comprises one or more microphones for generating appropriate microphone signals from the ambient sound. The generated microphone signal(s) is/are processed on the basis of an impaired hearing that is to be compensated for and is/are e.g., amplified, in particular on a frequency-band specific basis, and often subjected to a noise rejection, which, in the case of two or more microphone signals, can in particular also be effected by applying directional microphonics. The processed microphone signal (s) is/are used to generate an output signal that is output by an output transducer, such as a loudspeaker or a bone conduction receiver, as an output sound signal to the ear of the wearer of the hearing device.

Particularly quiet signals are often raised during the signal processing. This can firstly be effected after the relevant signal components have been detected as a wanted signal (e.g. soft speaking), but noise can then also be raised, that is to say amplified for the output, at the same time, in particular when wanted signals are simultaneously present in surroundings in which spatial hearing sensitivity is intended to be impaired as little as possible by directional microphonics.

The amplification of quiet signals can result in electronically or electro-acoustically induced inherent noise of the microphone(s) also being amplified as well and thus being output in the output sound signal at the same time. This, however, results in the impairment of the sound quality. If the signal components generated in a microphone signal by the ambient sound are stronger than the inherent noise of the microphone then they mask the inherent noise, which is why it is usually perceptible in the output sound signal only at low volumes.

Hearing devices therefore often apply algorithms to reject the inherent noise, which usually act on the basis of measured or estimated sound levels and/or noise levels. A central problem in this context is detecting the inherent noise to be rejected or distinguishing the inherent noise from other low-level signals.

BRIEF SUMMARY OF THE INVENTION

It is accordingly an object of the invention to provide a method of rejecting inherent noise of a microphone arrangement which overcomes a variety of disadvantages of the heretofore-known devices and methods of this general type and which provides for rejecting the inherent noise as precisely as possible and, in so doing, impairs sounds generated by the microphone arrangement from ambient sound as little as possible even at low signal levels.

With the above and other objects in view there is provided, in accordance with the invention, a method of rejecting inherent noise of a microphone arrangement having a first microphone and a second microphone, the method comprising:

generating with the first microphone a first microphone signal from a sound signal from the surroundings;

generating with the second microphone a second microphone signal from the sound signal from the surroundings;

ascertaining a measure of correlation between the first microphone signal and the second microphone signal; and rejecting inherent noise of at least one of the first microphone or the second microphone in the first or second microphone signal on a basis of the measure of correlation.

In other words, the objects of the invention are achieved according to the invention by a method for rejecting inherent noise of a microphone arrangement that comprises a first microphone and a second microphone, wherein the first microphone generates a first microphone signal from a sound signal from surroundings, wherein the second microphone generates a second microphone signal from the sound signal from the surroundings, wherein a measure of correlation between the first microphone signal and the second microphone signal is ascertained, and wherein inherent noise of the first microphone and/or of the second microphone in the first microphone signal or in the second microphone signal is rejected on the basis of the measure of correlation. Embodiments that are advantageous and, in some cases, inherently inventive are the subject matter of the description that follows and of the subclaims.

The term microphone in the present case generally covers any form of electroacoustic transducer that, according to its design and construction, is suitable and designed to generate from a sound signal from the surroundings an electrical signal in which voltage and/or current and/or power variations correspond at least approximately to the variations in the air pressure that are produced by the sound signal. The electrical signal generated by an electroacoustic transducer of this kind is accordingly referred to generally as microphone signal in this instance. In particular, the first and second microphones included in this case are also microphones in the narrower or actual sense, which thus involve the vibrations of changing air pressure being converted by means of a diaphragm into an electrical voltage signal as microphone signal. In this instance the microphone arrangement comprising the first microphone and the second microphone and possibly also further microphones is arranged in particular in a hearing device or in a communication apparatus such as for example a telephone or a headset.

A measure of correlation includes in particular any variable that allows a quantitative statement about statistical relationships between the first microphone signal and the second microphone signal and in particular indicates the extent to which the first microphone signal is similar to the second microphone signal in terms of its amplitude fluctuations and the phases thereof. The measure of correlation is preferably a normalized variable, that is to say such that a value range from 0 to 1 or from minus 1 to plus 1 is adopted, the value of plus 1 being adopted when the first microphone signal is exactly identical to the second microphone signal. In particular, the measure of correlation for a correlation between the first microphone signal x1 and the second microphone signal x2 in the form $$x2=\alpha\cdot x1+(1-\alpha)\cdot x2' \text{ with } x2'\neq x1$$

is monotonous for $\alpha$ against 1.

Inherent noise of the microphone arrangement in this instance includes in particular inherent noise of the first microphone and/or of the second microphone, inherent noise of this kind being able to be produced in particular by noise possibly occurring due to the situation or by background noise of the electronic and/or electroacoustic components of the respective microphone. In particular, inherent noise is thus noise that can occur independently of a sound signal occurring at the relevant microphone and can be maintained in particular even if the relevant microphone is completely shielded against any external sound.

Rejection of the inherent noise in the first microphone signal or in the second microphone signal means that either inherent noise of the first microphone that has found its way into the first microphone signal is rejected or inherent noise of the second microphone that has found its way into the second microphone signal is rejected, or inherent noise of both cited microphones in both aforementioned microphone signals is rejected. In this instance, rejection of the aforementioned inherent noise on the basis of the measure of correlation means in particular that a value of the measure of correlation is used for an activation and/or a degree of the extent of the rejection.

As such, it is advantageously possible to exploit the circumstance that in particular levels of strong sound signals that occur at the microphone arrangement can be assigned to one or a few, clearly localized, sound sources in the majority of cases. As a result, signal contributions produced by the ambient sound have a high level of correlation. By contrast, the signal contributions in the two microphone signals that involve inherent noise of each of the two microphones are uncorrelated, since the physical and electronic mechanisms on which the noise is based are independent of one another. It is therefore possible to activate rejection of the inherent noise in one of the two microphone signals, preferably in both microphone signals, and/or in a summed and/or directional signal formed from both microphone signals, for a sufficiently low level of correlation, accordingly ascertained through an associated value of the measure of correlation, and in particular to deactivate it for a sufficiently high level of correlation. Furthermore, a preferably antitone function can also control the degree of rejection on the basis of the measure of correlation, as a result of which a higher proportion of inherent noise in the microphone signals is assumed for decreasing correlation, and accordingly stronger rejection is implemented.

In particular, the rejection of the inherent noise on the aforementioned basis of the measure of correlation is applied in this instance to a directional signal generated by means of the microphone arrangement, the directional signal preferably being generated by virtue of the first microphone signal being overlaid with the second microphone signal, in particular in staggered fashion. Inherent noise in one of the two or in both microphones is then rejected directly in the generated directional signal. This makes use of the circumstance that inherent noise in both microphones arises in uncorrelated fashion (usually with amplitudes that are comparatively constant over time), as a result of which the inherent noise in a directional signal generated from the two microphone signals too is initially not effectively rejected, and hence rejection on the basis of the measure of correlation, on the other hand, permits sustained improvement of the noise characteristics.

In particular, such inherent noise can also be rejected when the aforementioned directional signal has weak directivity (even when the first and second microphone signals are overlaid omnidirectionally), since the rejection itself does not require directionality but rather, if inherent noise is detected on the basis of the measure of correlation, can be effected for example by means of spectral subtraction and/or a Wiener filter, which can be applied to omnidirectional signals too. In particular, such rejection of the inherent noise can also be applied to the two microphone signals directly.

The measure of correlation is preferably ascertained such that a possible time delay in the signal contributions in the first and second microphone signals relative to one another, which is based on the sound signal occurring at one of the two microphones with a time delay on account of an acoustic time-of-flight difference between the two microphones and the sound source, is taken into consideration as being due to time of flight and in particular is eliminated. This can be effected for example by a cross correlation function of the two microphone signals that is maximized for the temporal argument.

The rejection itself can be effected in particular by means of an inherently known method of noise rejection, that is to say for example by a Wiener filter. Such a method for rejecting inherent noise is described in our commonly assigned published patent application US 2018/0139546 A1, the disclosure of which is herewith incorporated by reference. On the other hand, the rejection can also be effected by means of frequency-band rejection on the basis of the frequency spectrum that can be assumed for the inherent noise of microphones. In particular, the assessment of background noise (as can be effected for a Wiener filter, for example) in this instance can also be performed on the basis of the measure of correlation in order to be able to assess more precisely those signal contributions in the two microphone signals that are due to inherent noise of the microphones.

The rejection of the inherent noise is preferably applied when the measure of correlation is below a predefined lower limit value. In particular, the rejection of the inherent noise is stopped when the measure of correlation is above a predefined upper limit value. In order to limit a possible impairment of the sound quality as a result of the application of the rejection of the inherent noise, this application is limited to cases in which a distinct presence of inherent noise is ascertained as a result of the measure of correlation.

A degree of the rejection of the inherent noise is advantageously set on the gradual basis and in particular antitone basis of the measure of correlation. This means in particular that the rejection of the inherent noise is applied to an even greater extent the lower the value of the measure of correlation. In this instance the functional dependence of the application of the rejection of inherent noise on the measure of correlation can additionally also provide for limit values for activation or complete deactivation. The degree of rejection can be influenced in particular by a gain factor that is to be applied to the first or second microphone signal, which gain factor can be ascertained by a Wiener filter, for example. In such a case, the Wiener filter can provide for an applicable gain or attenuation factor that is additionally decreased for a measure of correlation that decreases further.

It is found to be advantageous if, for a plurality of frequency bands, the measure of correlation is ascertained for the respective frequency band, and the inherent noise of the first microphone and/or of the second microphone in the signal component of the first microphone in the relevant frequency band or in the signal component of the second microphone signal in the relevant frequency band is rejected on the basis of the measure of correlation ascertained for the frequency band. This means in particular that the method is performed on the basis of frequency band when the measure of correlation between the first and second microphone signals in a frequency band is ascertained only on the basis of the signal components of the relevant frequency band, and in particular a limit value for the measure of correlation for an activation and/or deactivation of the rejection can be predefined on the basis of frequency band. The rejection of the inherent noise is effected separately for the relevant frequency bands, i.e. in particular different Wiener gain factors for different bands can be ascertained on the basis of the signal contributions (e.g. via signal and noise level) in the respective frequency bands, for example, and lowered further in accordance with the measures of correlation ascertained in the respective frequency band. The lowering can be applied to the signal components of the microphone signals in the respective frequency band or to the signal components of a weighted summed and/or directional signal, formed on the basis of the two microphone signals, that are present in the relevant frequency band.

Expediently, the measure of correlation used is a covariance and/or a coherence and/or a cross correlation. Integration of signal components of the first and second microphone signals, or of the power spectral densities, for the measure of correlation that is used is preferably performed over a suitable time window. In particular, when it is produced, the measure of correlation is purged as far as possible of a possible time delay in the two microphone signals that is based solely on time-of-flight differences in a sound signal in reference to the first and second microphones, as result of which such time delays are not included in the measure of correlation, or are included only as insignificantly as possible. In particular, the measure of correlation can be maximized in reference to a temporal argument.

In one advantageous embodiment, a wanted signal level and/or a power spectral density and/or a noise level and/or a noise power variable of a noise background is ascertained for the first microphone signal and/or for the second microphone signal, and the rejection of the inherent noise of the microphone arrangement is additionally controlled on the basis of the ascertained wanted signal level or the power spectral density or the noise level or the noise power variable. The noise power variable used in this case can be e.g. the noise power, possibly in a frequency band, or a noise power spectrum.

The cited level value(s) or spectral/power variable(s) can firstly be used for ascertaining a rejection factor for the inherent noise, e.g. within the context of a Wiener filter, and can secondly also be consulted for activating or deactivating the rejection as such. For example, the wanted signal level and the noise level can be used to ascertain a signal-to-noise ratio (SNR), and a high proportion of inherent noise can be inferred from a high SNR and low correlation. Similarly, a high proportion of inherent noise can be inferred from a low signal level and low correlation. On the other hand, a high signal level with low correlation can indicate an external noise signal, such as wind noise.

The inherent noise of the microphone arrangement is preferably rejected by means of a Wiener filter, in particular by applying the Wiener filter to the first and second microphone signals or to a weighted summed and/or directional signal formed on the basis of the first and second microphone signals. The aforementioned directional signal can be formed e.g. by overlaying the two microphone signals in temporally delayed, possibly weighted, fashion. While the inherent noise can also be rejected by means of other methods, a Wiener filter is particularly easy to control on the basis of the measure of correlation, since the Wiener filter, possibly on the basis of frequency band, outputs a respective gain factor to be applied to a specific signal, which gain factor is used to mask out, from the relevant signal, noise that needs to be rejected, in particular if no wanted signal component is detected in the signal. Such a gain factor can easily be multiplied by or convexly combined with a control function that is dependent on the measure of correlation. In particular, it is possible in this instance to exploit the circumstance that the amplitude spectrum of the inherent noise of microphones is known, or can be obtained by means of measurements and/or assessments beforehand. This additional information about the noise signal can be used as input variable for the Wiener filter for particularly effective rejection.

Preferably, firstly the wanted signal level and/or the power spectral density and secondly the noise level and/or the noise power variable are used as input variables for the Wiener filter, wherein the Wiener filter is applied to the first microphone signal and/or the second microphone signal on the basis of the measure of correlation. In particular, the Wiener filter, as described above, is multiplied by or convexly combined with a control function that is dependent on the measure of correlation, the control function preferably adopting a value close to or of exactly one for values of the measure of correlation below a lower limit value, which corresponds to activation of the rejection of the inherent noise, and/or adopting a value close to or of exactly zero for values of the measure of correlation above an upper limit value, which corresponds to deactivation of the rejection. In particular, the control function can continuously or occasionally continuously interpolate between one and zero for values of the measure of correlation between the lower and upper limit values. Activation of the rejection of the inherent noise can in particular also additionally be dependent on the noise level and/or the useful signal level, preferably by virtue of an applicable additional term with the aforementioned dependency in the control function.

The method preferably rejects inherent noise of two microphones of a hearing device. Two or even more microphones are increasingly being used in modern hearing devices in order to be able to isolate and/or selectively attenuate or emphasize different sound signals by means of directional microphonics. The highest possible signal quality is of great importance when a hearing device is used over as wide a dynamic range as possible. For hearing devices having at least two microphones, the method therefore permits inherent noise of the microphones to be reliably rejected if said inherent noise enters the realm of perceptibility, taking into consideration applicable ambient sound, and could therefore impair the signal quality. In particular the relative proximity of the two microphones in a hearing device (on a longitudinal scale in reference to the wavelengths that occur) permits particularly precise isolation of the inherent noise from noise due to sound in a microphone signal as a result of the measure of correlation. In particular, a single unit of a hearing device is used in this instance, that is to say a monaural hearing device, or a local hearing device (which a user is intended to wear on his ear) in the case of a binaural hearing device system, both microphones of the microphone arrangement being arranged in the hearing device and in particular within a housing of the hearing device.

The invention further cites a hearing device having a microphone arrangement and a control unit, wherein the microphone arrangement comprises a first microphone for generating a first microphone signal from a sound signal from the surroundings and a second microphone for generating a second microphone signal from the sound signal from the surroundings, and wherein the control unit is designed to reject inherent noise of the microphone arrangement by using the method described above. The hearing device according to the invention shares the advantages of the method according to the invention. The advantages indicated for the method and for the developments thereof can be transferred mutatis mutandis to the hearing device. In particular, the control unit in this instance is designed to receive the first and second microphone signals and to perform the appropriate signal processing steps of the method.

Other features which are considered as characteristic for the invention are set forth in the appended claims.

Although the invention is illustrated and described herein as embodied in method for rejecting inherent noise of a microphone arrangement, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Mutually corresponding parts and variables are provided with identical reference signs throughout the figures.

DETAILED DESCRIPTION OF THE INVENTION

Figure 1:
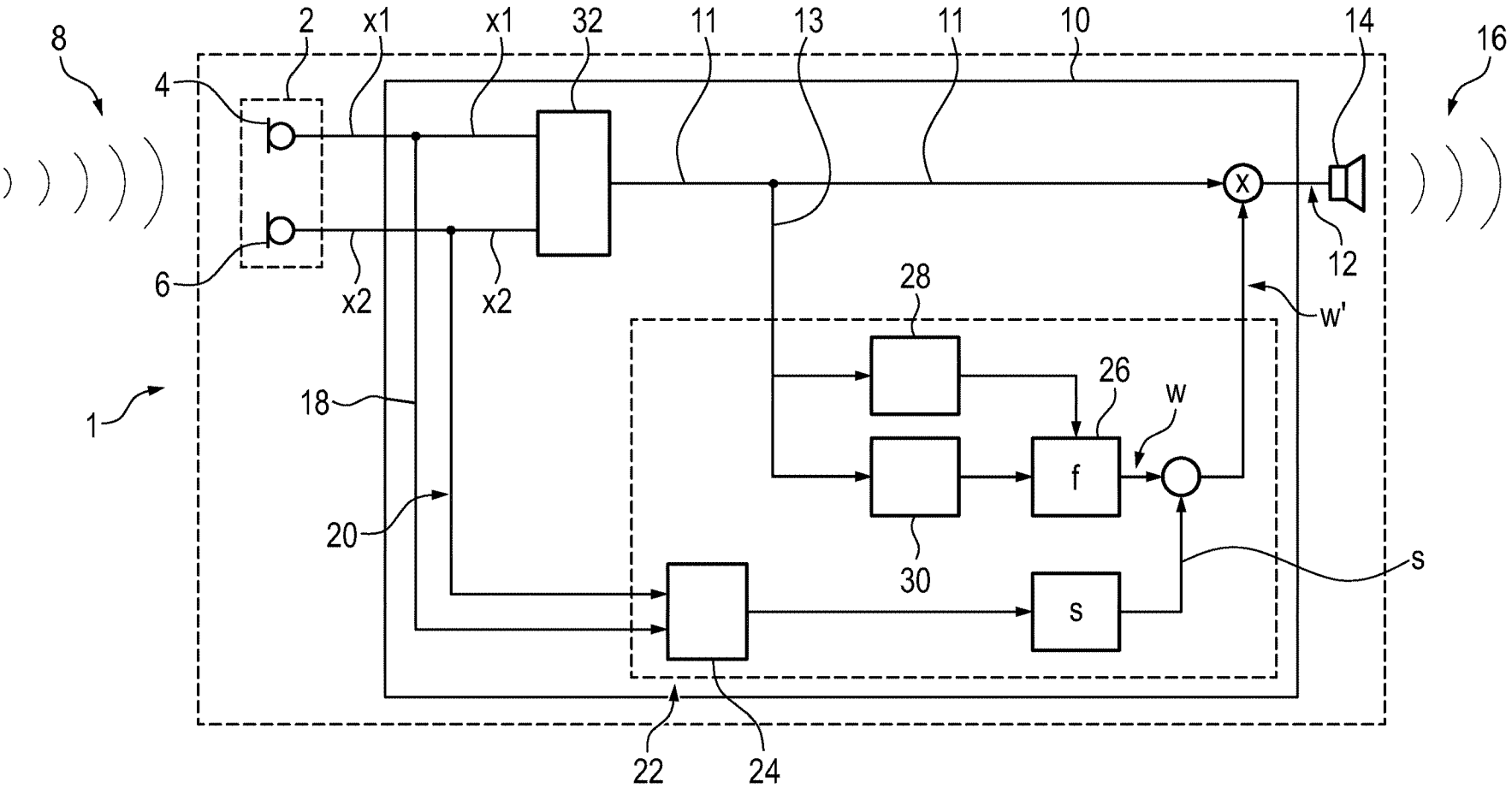
FIG. 1 shows a block diagram of a hearing device having two microphones and a Wiener filter for rejecting inherent noise of the microphones.

Referring now to the figures of the drawing in detail and first, in particular, to FIG. 1 thereof, there is shown a block diagram of a hearing device 1 having a microphone arrangement 2. The microphone arrangement 2 comprises a first microphone 4 and a second microphone 6. The first microphone 4 is designed to generate a first microphone signal x1 from a sound signal 8 from surroundings, i.e., an ambient sound signal 8, of the hearing device 1. The second microphone 6 is designed to generate a second microphone signal x2 from the sound signal 8 from the surroundings of the hearing device 1. The first microphone signal x1 and the second microphone signal x2 are supplied to a control unit 10, which has processing and storage means, not depicted in more detail, in the form of one or more signal processors, RAM modules, etc., and in which the two microphone signals x1, x2 are processed by taking into consideration an impaired hearing of a user of the hearing device 1 that needs to be compensated for.

The control unit 10 uses the aforementioned signal processing to generate from the first microphone signal x1 and the second microphone signal x2 an output signal 12 that is converted into an output sound signal 16 by an output transducer of the hearing device 1, in the present case provided by a loudspeaker 14. The output sound signal 16 is supplied to the ear of the wearer of the hearing device 1. The output transducer used in this instance may also be in particular a bone conduction receiver or any other electroacoustic transducer designed to generate a sound signal from the output signal 12.

In the control unit 10, a first secondary signal path 18 is branched off from the first microphone signal x1 and a second secondary signal path 20 is branched off from the second microphone signal x2. The first and second secondary signal paths 18, 20 are supplied to inherent noise rejection 22, which can be implemented in the control unit 10 as an appropriate software module or else by appropriate, hardwired, circuits (for example as an ASIC), for example. A measure of correlation 24 is formed in the inherent noise rejection 22 from the first microphone signal x1, as is present in the first secondary signal path 18, and from the second microphone signal x2, as is present in the second secondary signal path 20.

For example, the measure of correlation 24 can be a cross correlation function of the two microphone signals that is maximized for the temporal argument of the afore-mentioned function, and possibly normalized in a suitable manner. The measure of correlation 24 used can likewise be the cross-power spectrum of the two microphone signals x1, x2, which may need to be normalized in a suitable manner.

The first microphone signal x1 and the second microphone signal x2 are moreover processed in the control unit 10 by directional microphonics 32 to form a preliminary output signal 11. A further secondary signal path 13 is branched off from the preliminary output signal 11, and said further secondary signal path is supplied to the inherent noise rejection 22, which furthermore has a Wiener filter 26. Such a Wiener filter is described in the above-mentioned patent application US 2018/0139546 A1, for example. A wanted signal level 28 and a noise power 30 are then ascertained in the inherent noise rejection 22 from the signal components of the preliminary output signal 11 in the secondary signal path 13 on the basis of frequency band. The splitting into individual frequency bands in this instance can be effected upstream of the directional microphonics 32 already by means of a filter bank (not depicted in more detail). On the basis of the wanted signal level 28 and the noise power 30, a filter function f, the arguments of which are the two aforementioned variables, in the Wiener filter 26 is used to ascertain a gain factor w that is intended to be used to reject inherent noise of the first microphone 4 and/or of the second microphone 6 in the preliminary output signal 11 by means of appropriate multiplication by the preliminary output signal 11.

The application of the gain factor w for rejecting the aforementioned inherent noise is effected in this instance on the basis of a control function s that includes the measure of correlation 24 of the two microphone signals x1, x2 as argument. A gain factor w' is therefore formed from the gain factor w of the Wiener filter 26 and the control function. The control function s is in this case preferably such that a high level of correlation between the first microphone signal x1 and the second microphone signal x2 results in the gain factor w being applied to the preliminary output signal 11 only a little or not at all, since in this case it is assumed that even substantial noise components in the preliminary output signal 11 and hence also in the aforementioned microphone signals x1, x2 come from noise in the sound signal 8. Accordingly, inherent noise of the microphone arrangement 2 (that is to say from at least one of the two microphones 4, 6), if present in the first place, is masked by the applicable signal components of the sound signal 8. In such a case, the control function s adopts a value of 0 or close to 0. If, however, it is established on the basis of the measure of correlation 24 that there is no significant correlation between the first microphone signal x1 and the second microphone signal x2, then it is assumed that the substantial and mutually uncorrelated signal components in the two microphone signals x1, x2 come from inherent noise of the microphone arrangement 2. Accordingly, a value of the control function s is set such that the gain factor w is applied to the preliminary output signal resulting from the two microphone signals x1, x2 (almost) to the full extent, and that the applicable contribution of the gain factor w is therefore included in the actually applied gain factor w' (almost) completely. The value of the control function s is therefore 1 or almost 1. By applying the gain factor w to the preliminary output signal 11 in the respective frequency band, the output signal 12 is formed, which can furthermore be subjected to still further signal processing steps, not depicted in more detail, before the loudspeaker 14 effects the conversion into the output sound signal 16.

Figure 2:
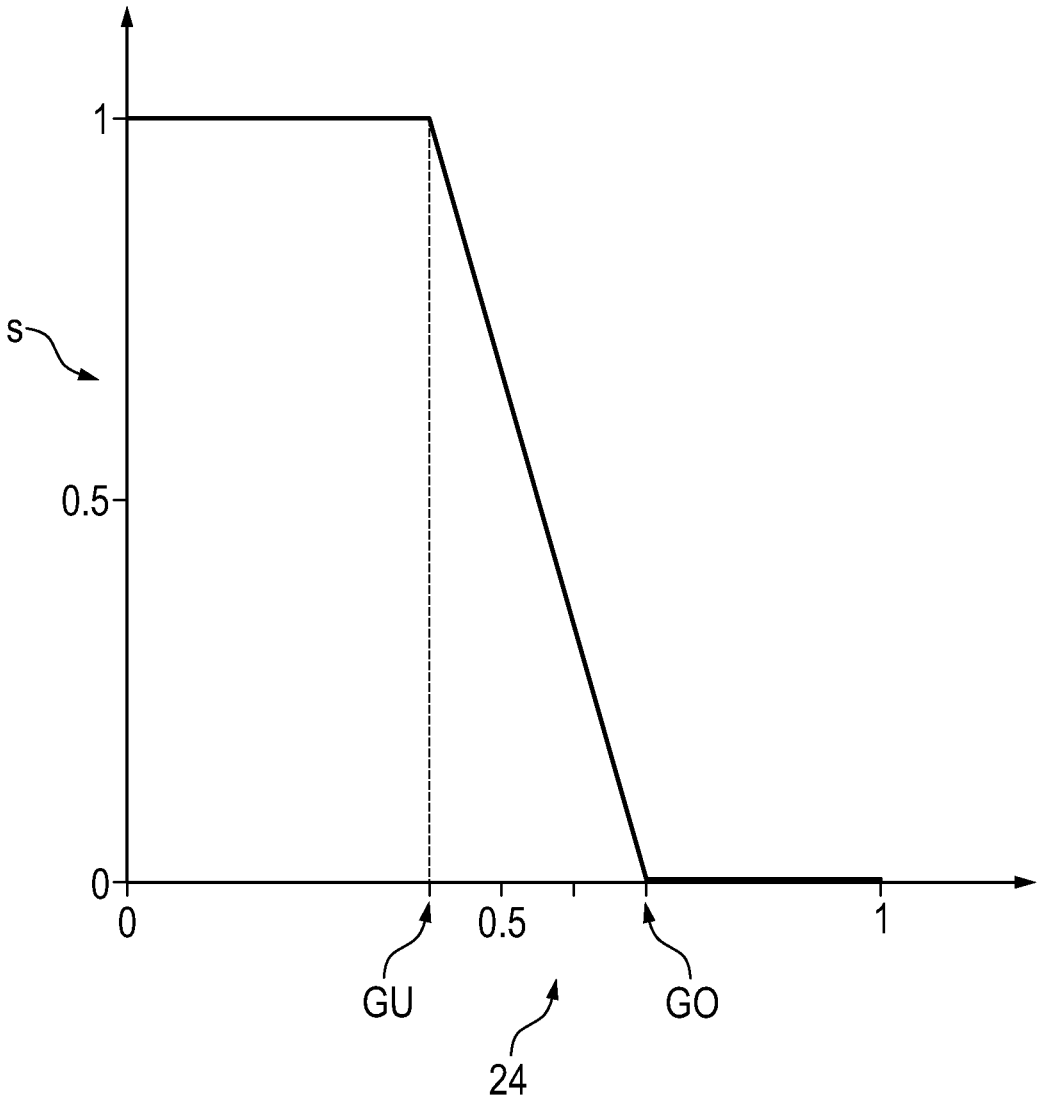
FIG. 2 shows a graph of a control function for the Wiener filter shown in FIG. 1 as a function of a measure of correlation.

The characteristic of the control function s as a function of the measure of correlation 24 is depicted schematically in FIG. 2. The normalized measure of correlation 24 assumes values between 0 and 1 as argument for the control function s, with 0 representing completely uncorrelated microphone signals and 1 representing perfectly correlated microphone signals x1, x2. The control function s, plotted on the ordinate, for its part assumes values between 0 and 1, a value of 1 according to the Wiener filter 28 shown in FIG. 1 resulting in the gain factor w produced there being applied to the two microphone signals x1, x2 completely, and a value of 0 for the control function s resulting in such application being omitted completely. The control function s assumes the value 1 for values of the measure of correlation 24 up to a lower limit value GU, or lower threshold GU. The lower limit value GU is therefore the value for the correlation, measured using the measure of correlation 24, below which the two microphone signals x1 and x2 are assumed to be sufficiently uncorrelated to reliably determine the inherent noise. For values of the measure of correlation 24 above an upper limit value GO, or upper threshold GO, the control function s assumes the value 0, as result of which the rejection of the inherent noise using the gain factor w ascertained in the Wiener filter 26 shown in FIG. 1 is therefore stopped completely. Between the lower limit value GU and the upper limit value GO there is continuous interpolation of the control function s, which is linear in the example shown in FIG. 2 but can also have a different characteristic, so long as said characteristic remains antitone (in particular the characteristic of the control function s can also gradually fall from 1 to 0). It will be noted here that the measure of correlation 24 is limited to values between 0 and 1 merely on account of applicable normalization; other definition ranges are conceivable.

The control function s in this instance can additionally have a dependency—not depicted in more detail in the present case—on the signal level and/or on the noise level that is similar in form, based on the characteristic depicted in FIG. 2, to the dependency on the measure of correlation 24, that is to say in particular provides for complete application of the gain factor w for a low signal level and/or noise level and provides for complete stoppage of the rejection of inherent noise for high signal levels and/or noise levels (above a predefined upper limit).

The applicable value of the control function s for the ascertained value of the measure of correlation 24 is now applied to the gain factor w ascertained by the Wiener filter, for example by means of a convex combination in the form $$w'=w\cdot s+(1-s),$$

and the gain factor w' thus ascertained is applied to the directional signal (the preliminary output signal 11) formed on the basis of the first microphone signal x1 and the second microphone signal x2. The hearing-device specific signal processing 32 for compensating for the impaired hearing of the wearer of the hearing device 1 is preferably effected after the inherent noise rejection 22 so as not, by means of subsequent amplifications, to additionally amplify possible inherent noise of the microphone arrangement 2 as well and thus to minimize the entry of possible inherent noise of the microphone arrangement 2 into the output signal 12 as far as possible.

Although the invention has been illustrated and described more thoroughly in detail by the preferred exemplary embodiment, the invention is not limited by this exemplary embodiment. Other variations can be derived therefrom by a person skilled in the art without departing from the scope of protection of the invention.

The following is a summary list of reference numerals and the corresponding structure used in the above description of the invention:

1 hearing device
2 microphone arrangement
4 first microphone
6 second microphone
8 sound signal
10 control unit
11 preliminary output signal
12 output signal
13 (further) secondary signal path
14 loudspeaker
16 output sound signal
18 first secondary signal path
20 second secondary signal path
22 inherent noise rejection
24 measure of correlation
26 Wiener filter
28 wanted signal level
30 noise power
32 directional microphonics
f filter function
GU lower limit value
GO upper limit value
s control function
x1 first microphone signal
x2 second microphone signal
w gain factor
w' gain factor

The invention claimed is:

1. A method of rejecting inherent noise of a microphone arrangement having a first microphone and a second microphone, the method comprising:

generating with the first microphone a first microphone signal from a sound signal from the surroundings;

generating with the second microphone a second microphone signal from the sound signal from the surroundings;

ascertaining a measure of correlation between the first microphone signal and the second microphone signal;

rejecting inherent noise of at least one of the first microphone or the second microphone in the first or second microphone signal on a basis of the measure of correlation; and ascertaining at least one parameter selected from the group consisting of a wanted signal level, a power spectral density, a noise level, and a noise power variable for the first microphone signal and/or for the second microphone signal; and additionally controlling a rejection of the inherent noise of the microphone arrangement on a basis of at least one of the signal parameters, and rejecting the inherent noise of the microphone arrangement by way of Wiener filter;

using the wanted signal level and/or the power spectral density or using the noise level and the noise power variable as input variables for the Wiener filter; and applying the Wiener filter to at least one of the first microphone signal or the second microphone signal in dependence on the measure of correlation.

2. The method according to claim 1, which comprises rejecting the inherent noise when the measure of correlation undershoots a predefined lower limit value.

3. The method according to claim 1, which comprises setting a degree of a rejection of the inherent noise in gradual dependence on the measure of correlation.

4. The method according to claim 1, which comprises:

ascertaining the measure of correlation respectively for each of a plurality of frequency bands; and rejecting the inherent noise of one or both of the first microphone or the second microphone in a signal component of the first microphone in the respective frequency band or in a signal component of the second microphone signal in the respective frequency band based of the measure of correlation ascertained for the respective frequency band.

5. The method according to claim 1, wherein the measure of correlation is at least one measure selected from the group consisting of a covariance, a coherence, and a cross correlation.

6. The method according to claim 1, wherein the microphone arrangement is a component of a hearing device and the method comprises rejecting inherent noise of two microphones of the hearing device.

7. A hearing device, comprising:

a microphone arrangement with a first microphone for generating a first microphone signal from a sound signal from surroundings of the hearing device and a second microphone for generating a second microphone signal from the sound signal from the surroundings of the hearing device; and a control unit connected to receive the first and second microphone signals from the microphone arrangement and configured to reject inherent noise of the microphone arrangement by carrying out the method according to claim 1.

* * * * *